US007886879B2

(12) United States Patent
Kocher et al.

(10) Patent No.: US 7,886,879 B2
(45) Date of Patent: Feb. 15, 2011

(54) METHOD FOR CREATING TEMPORARY SAFETY SPACE WITHIN AN ELEVATOR HOISTWAY

(75) Inventors: Johannes Kocher, Udligenswil (CH); Eamon Mc Govern, Lucerne (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 11/981,919

(22) Filed: Oct. 31, 2007

(65) Prior Publication Data

US 2008/0073158 A1 Mar. 27, 2008

Related U.S. Application Data

(63) Continuation of application No. 10/804,243, filed on Mar. 18, 2004, now Pat. No. 7,322,445.

(30) Foreign Application Priority Data

Mar. 31, 2003 (EP) ..... 03405215

(51) Int. Cl.
*B66B 7/00* (2006.01)
*B66B 5/00* (2006.01)
*B66B 7/02* (2006.01)

(52) U.S. Cl. ..... 187/414; 187/351; 187/359; 187/377; 187/406

(58) Field of Classification Search ..... 187/282, 187/351, 359, 377, 406, 414, 306, 365, 371, 187/374, 378, 379; *B66B 5/00, 7/02, 7/00, B66B 5/04, 5/28, 13/28*

See application file for complete search history.

(56) References Cited

U.S. PATENT DOCUMENTS

| | | | | |
|---|---|---|---|---|
| 311,783 | A * | 2/1885 | Rau et al. | 187/359 |
| 630,424 | A * | 8/1899 | Terry et al. | 187/365 |
| 846,807 | A * | 3/1907 | Thornber | 187/371 |
| 887,193 | A * | 5/1908 | Heiling | 187/365 |
| 2,563,514 | A | 8/1951 | Brosamer | |
| 5,613,576 | A | 3/1997 | Lamb | |
| 5,651,429 | A | 7/1997 | Lin | |
| 5,738,017 | A * | 4/1998 | Behringer | 104/250 |
| 5,773,771 | A | 6/1998 | Chatham | |
| 6,138,798 | A | 10/2000 | Macuga | |
| 6,164,418 | A | 12/2000 | Chen et al. | |
| 6,435,316 | B1 | 8/2002 | Ando | |
| 6,860,501 | B2 | 3/2005 | Schmidt et al. | |
| 2007/0205058 | A1 * | 9/2007 | Caballero et al. | 187/306 |

FOREIGN PATENT DOCUMENTS

| | | |
|---|---|---|
| DE | 100 65 099 | 7/2002 |

(Continued)

*Primary Examiner*—Michael R Mansen
*Assistant Examiner*—Stefan Kruer
(74) *Attorney, Agent, or Firm*—Woff & Samson, PC

(57) ABSTRACT

A method for creating a temporary safety space within an elevator hoistway by preventing upward or downward movement of a car or counterweight along guide rails. The method includes the steps of providing engagement members on the guide rails and extending support struts from the car or counterweight to either side of a guide blade of the guide rail, whereby upward or downward movement of the car or counterweight along the guide rail is prevented when the extended support struts bear against the engagement members.

8 Claims, 4 Drawing Sheets

FOREIGN PATENT DOCUMENTS

| | | | | |
|---|---|---|---|---|
| EP | 0 922 663 | | | 6/1999 |
| EP | 0 985 628 | | | 3/2000 |
| EP | 0 725 033 | | | 5/2001 |
| EP | 1 386 876 | | | 2/2004 |
| FR | 2795060 | A1 | * | 12/2000 |
| JP | 03083782 | A | * | 4/1991 |
| JP | 03-083782 | A | | 9/1991 |
| JP | 03-056378 | A | | 11/1991 |
| JP | 10059662 | A | * | 3/1998 |
| JP | 2000203774 | A | * | 7/2000 |
| JP | 2005343579 | A | * | 12/2005 |
| WO | WO 00/47510 | | | 8/2000 |
| WO | WO 02096791 | A1 | * | 12/2002 |
| WO | WO 2005032992 | A1 | * | 4/2005 |

* cited by examiner

METHOD FOR CREATING TEMPORARY SAFETY SPACE WITHIN AN ELEVATOR HOISTWAY

The present application is a continuation of the patent application Ser. No. 10/804,243, filed Mar. 18, 2004, now U.S. Pat. No. 7,322,445 the entire contents of which are incorporated herein by reference.

BACKGROUND OF THE INVENTION

The present invention relates to a device and procedure for creating and securing a temporary safety space within an elevator hoistway such that a service or maintenance engineer can work with impunity from a car entering the safety space. In particular, the invention provides a stop bar for mounting within the hoistway to prevent movement of the car into the safety space.

In recent years pressure within the elevator industry to reduce the space consumption of installations has increased dramatically. This has resulted in the design of modern elevator systems in which:

a) the entire hoistway length is used for the travel of the car during normal operating conditions. Accordingly here are no permanent, dedicated safety spaces in the head and pit of the hoistway; and b) the machine is no longer accommodated within a separate room but is also mounted within the hoistway.

Hence, there is a requirement to provide a temporary safety space within the hoistway of modern systems before maintenance or service work can be carried out. Furthermore, when the machine is mounted in the hoistway, the frequency at which the hoistway must be accessed for maintenance or service work is increased. Accordingly, it is important that the means for creating the temporary safety space can be established and reset quickly and reliably.

Many prior art solutions have been proposed to create the necessary temporary safety spaces. For example, EP-A-0985628, illustrates height adjustable railing members disposed on the top of the roof of an elevator car. During normal elevator operation, the railing members are maintained in a position lower than the highest protrusion from the car roof so that they do not interfere with the travel of the elevator. When maintenance is to be carried out, the railing members are raised to an upright position, thereby establishing a temporary safety space defined between the top of the car and the top of the railing members.

A similar solution is described in WO-A-02085773 wherein a folding framework is mounted on top of the roof of the elevator car. When maintenance is to be carried out, the framework is unfolded and extends vertically above the car to establish a safety space.

A common problem associated with these two solutions is that they are only capable of establishing a safety space in the headroom of the hoistway above the car. Furthermore, the railing members of framework extend vertically through the safety spaces and they create and this may impede the maintenance engineer in carrying out the required work.

A common approach is establishing the required safety space in the pit of the hoistway is described in EP-A-0725033. A buffer is pivotably mounted to the floor of the pit. In normal elevator operating conditions the buffer is retained in a vertical position where it has no influence on the travel of the elevator car. When work is to be carried out in the pit, the buffer is released from its retained position and tilts under gravity into a safety position where it prevents travel of the car into the pit. Similar supports are described in DE-A-10065099. Again, however, these safety devices when creating a safety space in the pit actually extend through the safety space and this may impede the maintenance engineer in carrying out the required work.

U.S. Pat. No. 5,773,771 describes an apparatus for restricting the motion of an elevator car. The apparatus consists of two bolts extensible from either side of a bottom bolster channel supporting the car. In the extended position, the bolts engage with steel plates mounted to the guide rails thereby preventing upward motion of the car. If a service technician is working on the top of the car, it would be difficult, if not impossible, for him to see whether the bolts have extended and correctly engaged with the steel plates. Hence, he cannot be entirely confident that the car has been prevented from moving.

SUMMARY OF THE INVENTION

Accordingly there is a need to overcome the aforementioned problems associated with the prior art by providing a simple, effective, reliable and visible means and method of creating both pit and headroom safety spaces which does not intrude into the safety space so established to hamper maintenance work.

Pursuant to the present invention, an assembly is presented for providing a temporary safety space within an elevator hoistway wherein upward or downward movement of a car or a counterweight along guide rails is prevented. The assembly includes engagement members provided on the guide rails and a stop bar having opposing ends that bear against the engagement members. The engagement members can be arranged to permanently secure the guide rail to the hoistway, can be a hole provided in the guide rail, or temporarily fixed to the guide rail to create the temporary safety space.

Another aspect of the invention resides in a method for creating such a temporary space within an elevator hoistway. The method includes switching a control system to an inspection mode, providing engagement means on the guide rails and installing a stop bar having opposing ends which bear against the engagement means. The engagement means can be bolts used to permanently secure the guide rail to the hoistway, holes in the guide rail, or bolts temporarily fixed to the guide rail.

BRIEF DESCRIPTION OF THE DRAWINGS

By way of example only, preferred embodiments of the present invention will be described in detail with reference to the accompanying drawings, of which.

DETAILED DESCRIPTION OF THE INVENTION

Figure 1:
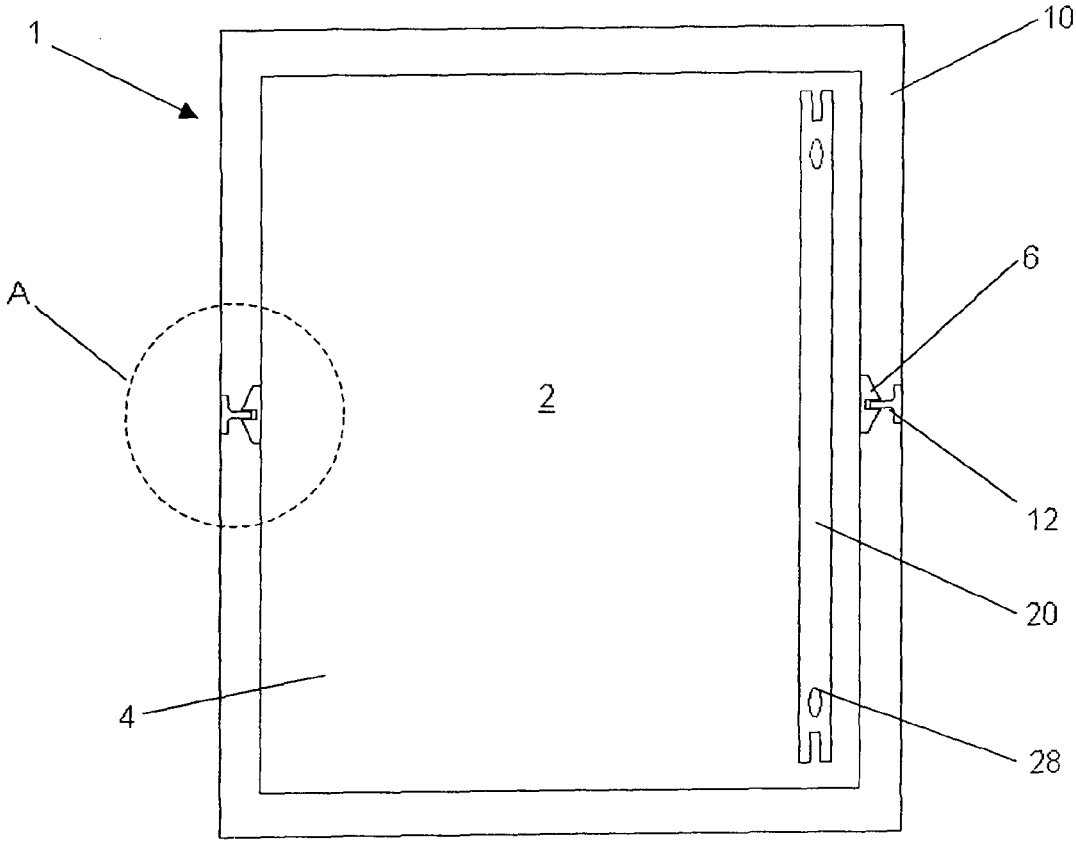
FIG. 1 is a plan view of an elevator system showing a car within a hoistway and a stop bar according to the present invention in its stored position on top of the car.

FIG. 1 is a plan view from above a car 2 mounted within a hoistway 10 of an elevator system 1. Two guide shoes 6 mounted on opposing sides of the car 2 slide along corresponding guide rails 12 affixed to opposing walls of the hoistway 10 to retain the car 2 in a centralized position as it moves up and down (out of and into the plane of the page) within the hoistway 10. A stop bar 20 according to the present invention is stored on a rooftop 4 of the car 2.

Figure 2:
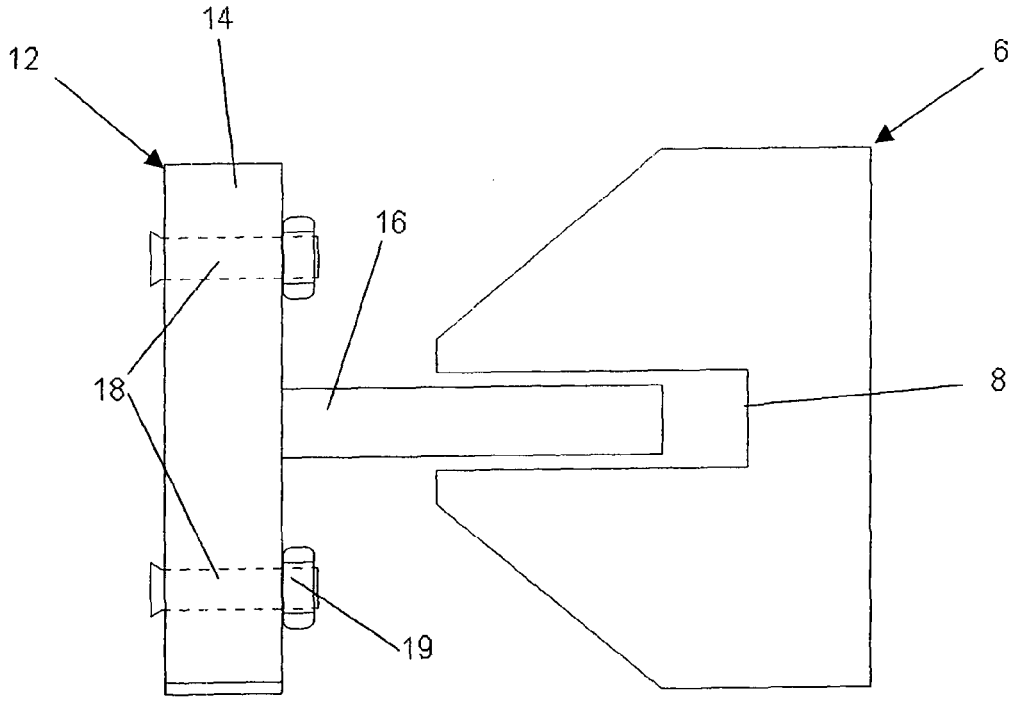
FIG. 2 is an expanded view of segment A of FIG. 1 showing the cooperation between a guide rail and a guide shoe of the elevator system.

FIG. 2 is an expanded view of segment A of FIG. 1 showing in more detail the relationship between one of the guide shoes 6 and the associated guide rail 12. The guide rail 12 comprises a support flange 14 and a guide blade 16 extending in towards the center of the hoistway 10. The guide rail 12 is positioned and mounted onto the hoistway 10 by fixing bolts 18 that pass through the support flange 14 and is secured thereto by corresponding nuts 19, the bolts 18 and nuts 19 serve as engagement members, as will become clear from the discussion below. The guide shoe 6 is provided with a slot 8 that partially envelops the guide blade 16. Accordingly, the car 2 is prevented from moving significantly away from its central line of travel by engagement of the guide blade 16 with the side walls of the slot 8.

When maintenance/inspection work is to be carried out in the hoistway 10 the technician stops the car 2 at a predetermined level in the vicinity of a specific landing door of the hoistway 10, opens that landing door and climbs onto the roof 4 of the car 2. From there the technician switches the control system of the elevator 1 to inspection mode thereby enabling the car 2 to travel at a reduced speed upwards or downwards within the hoistway 10 under the supervision of the technician.

Figure 3:
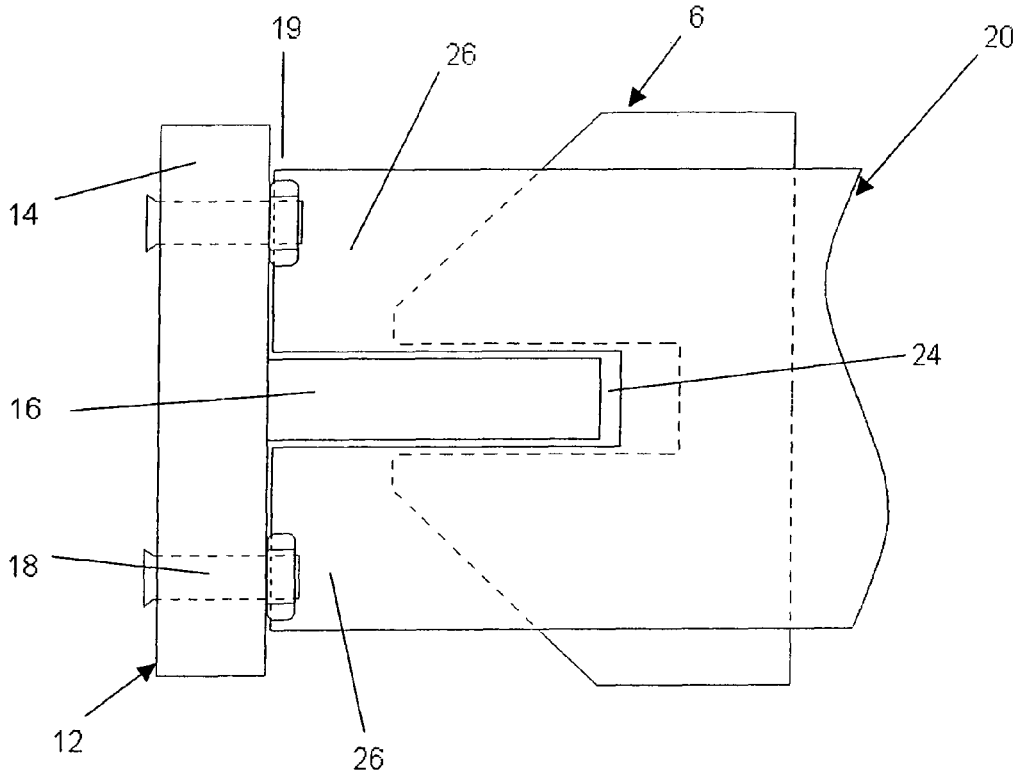
FIG. 3 corresponds with FIG. 2 but showing the stop bar in position to prevent upward travel of the car.
Figure 4:
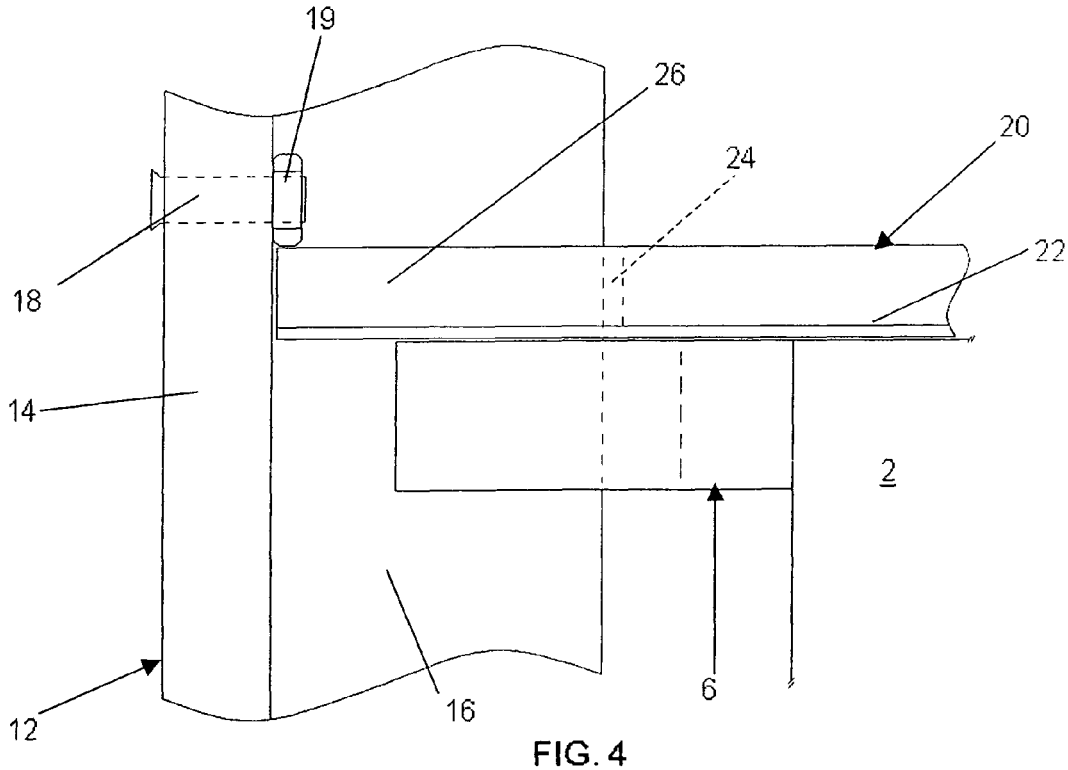
FIG. 4 is a side view of the arrangement shown in FIG. 3.

In order to create a temporary safety space above the car 2, the stop bar 20 is arranged as shown in FIGS. 3 and 4. The stop bar 20 has opposing ends each having two support struts 26 with a channel 24 therebetween. Initially the technician moves the car 2 up towards, but not into, the proposed temporary safety space. Then the stop bar 20 is removed from its stored position, as shown in FIG. 1, and the guide blades 16 of the guide rails 12 are inserted into the opposing channels 24 of the stop bar 20. The car 2 is then moved upwards slightly until the support struts 26 bear against a lower surface of the nuts 19 securing the guide rail 12 to the hoistway 10, as shown specifically in FIG. 4. In this position, with the stop bar 20 sandwiched between the roof 4 of the car 2 and the nuts 19, the car 2 is prevented from further upward motion and thereby the upper safety space is created.

To reduce the initial and any subsequent impact forces between the stop bar 20 and the car 2 a layer of resilient material 22 such as rubber is provided on the lower surface of the stop bar 20.

Figure 5:
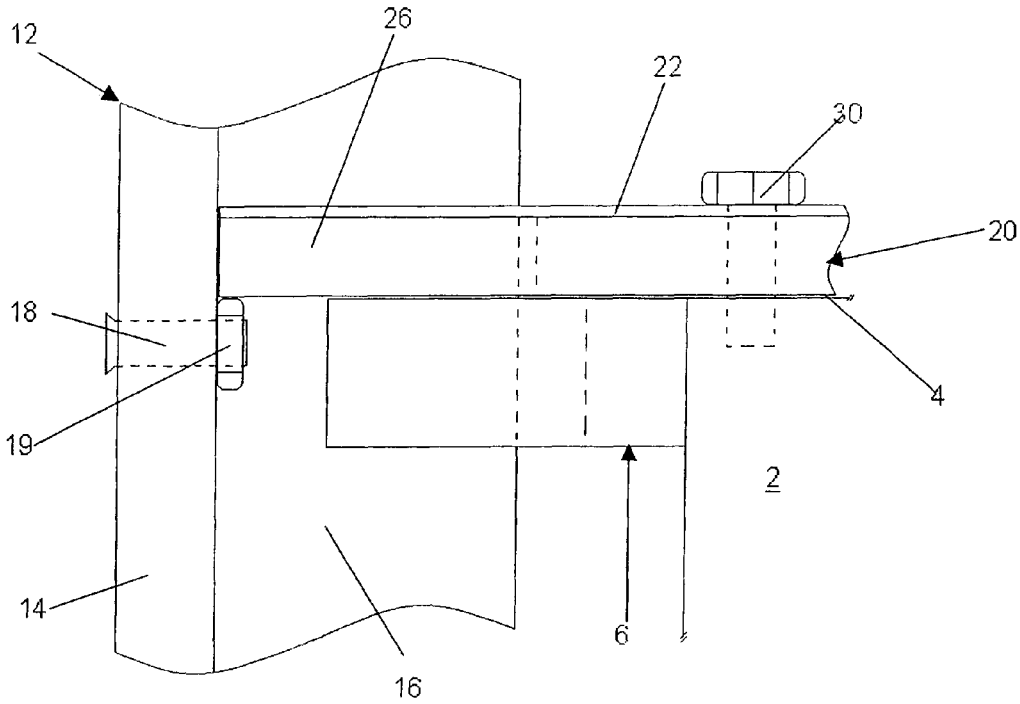
FIG. 5 corresponds to FIG. 4 but with the stop bar in a position where it prevents downward travel of the car.

In order to create a temporary safety space in a pit of the hoistway 10 below the car 2, the stop bar 20 is arranged as shown in FIG. 5. Initially the technician moves the car 2 down towards, but not into, the proposed temporary safety space. Then the stop bar 20 is removed from its stored position, as shown in FIG. 1, and again the guide blades 16 of the guide rails 12 are inserted into the opposing channels 24 in the stop bar 20. On this occasion, however, the stop bar 20 must be fixed to the roof 4 of the car 2. This is achieved by inserting bolts 30 through slots 28 provided in the bar 20 and fastening them to the roof 4 of the car 2. The car 2 can then be moved downwards slightly until the support struts 26 bear against an upper surface of the nuts 19 securing the guide rail 12 to the hoistway 10. In this position, the car 2 is prevented from further downward motion and thereby the lower safety space is created.

Although the guide shoes 6 of this particular embodiment are positioned at the top of the car 2, it will be appreciated that the shoes 6 can be mounted at any position along the height of the car 2.

Figure 6:
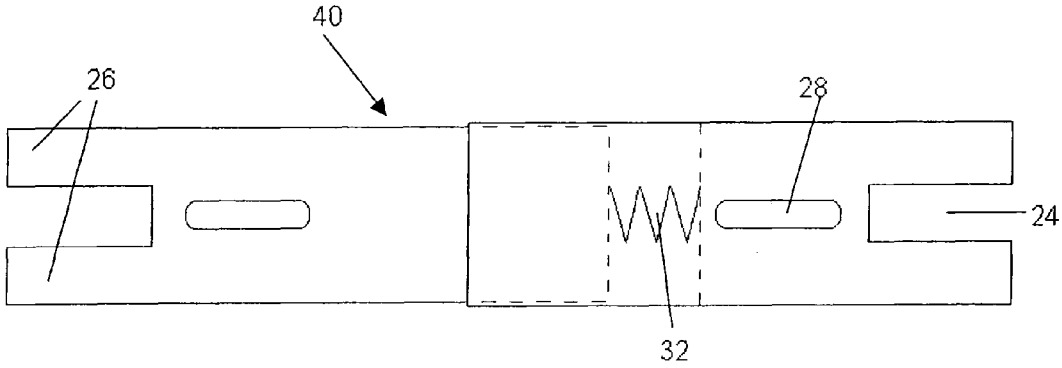
FIG. 6 illustrates a telescopic stop bar according to a second embodiment of the present invention.

Over time the opposing guide rails 12 of an elevator system 1 can become misaligned. Accordingly, the distance between them can vary along the length of the hoistway 10. The stop bar 20 of the previously described embodiment, being of a single-piece construction, cannot account or adjust for these changes. Accordingly, an alternative, telescopic stop bar 40 as shown in FIG. 6 was developed. The stop bar 40 shares all of the features of the previous embodiment but additionally it is of a two-piece construction. The ends of the stop bar 40 are biased against each other by a compression spring 32. Hence the stop bar 40 automatically adjusts to the distance between the opposing guide rails 12 even if that distance changes along the length of the hoistway 10.

Figure 7:
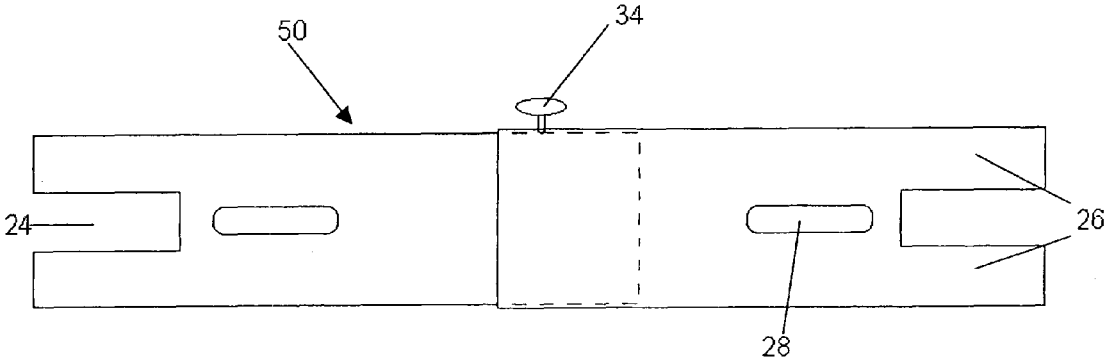
FIG. 7. illustrates a further telescopic stop bar according to a third embodiment of the present invention.

FIG. 7 illustrates a manually adjustable stop bar 50 according to a third embodiment of the invention. Again the stop bar 50 is of a two-piece, telescopic construction. When in position so that the stop bar 50 spans the distance between the opposing guide rails 12, the technician locks the two pieces together by means of screw pin 34.

Obviously the embodiments of FIGS. 6 and 7 can be combined so that the two telescopic pieces of the stop bar are locked together in the stored position so that it is of minimal length. Then, when required, the screw pin 34 can be released and the compression spring 32 forces the two pieces apart to engage with the opposing guide rails 12 within the hoistway 10.

Figure 8:
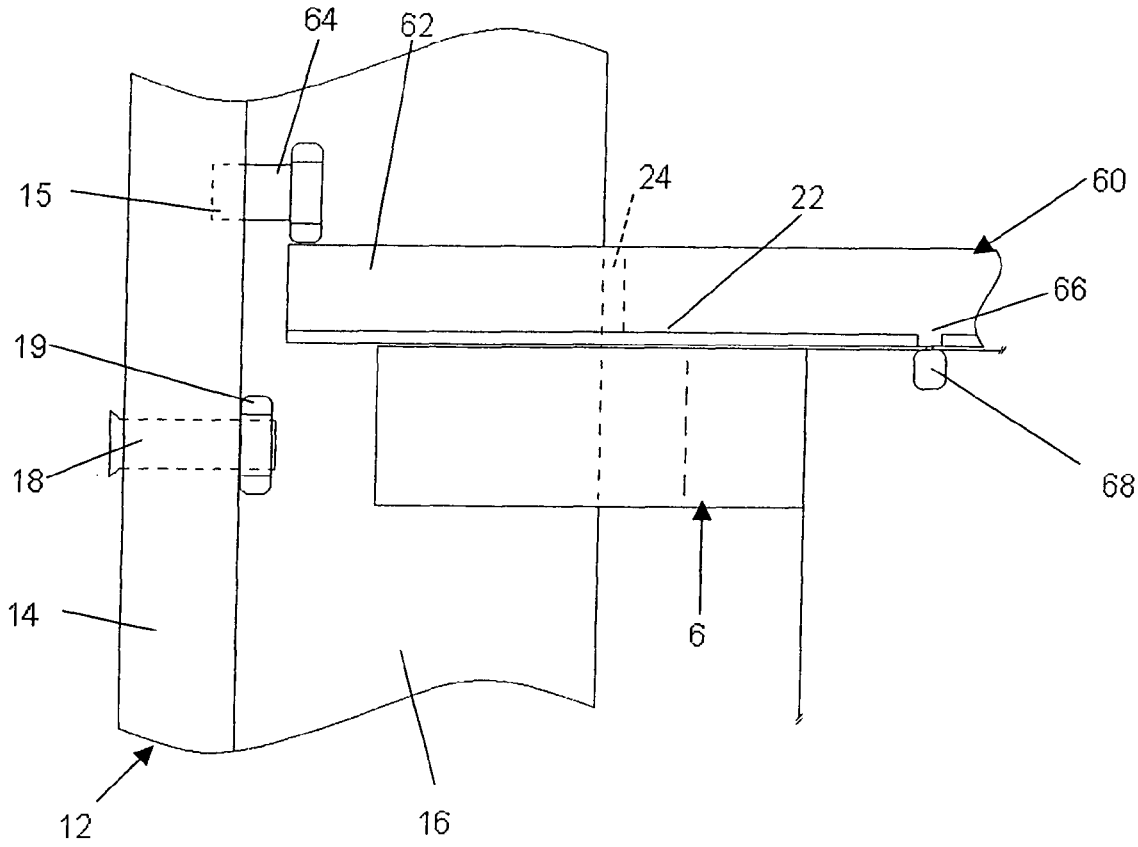
FIG. 8 corresponds with FIG. 4 but showing a stop bar according to a fourth embodiment of the present invention.

Instead of using the bolts 18 and the nuts 19 on the guide rails 12, temporary fastening means such a clamp or bolt could be used to secure the ends of the stop against the guide rails 12 as illustrated in FIG. 8 which shows a further stop bar 60 in accordance with a fourth embodiment of the invention. The arrangement shown is similar to that of FIG. 4 but it will be appreciated that the stop bar 60 is shorter than that of FIG. 4.

Again when maintenance inspection work is to be carried out in the hoistway 10 the technician stops the car 2 at a predetermined level in the vicinity of a specific landing door of the hoistway 10, opens that landing door and climbs onto the roof 4 of the car 2. Instead of manually switching the control system of the elevator 1 to inspection mode, the technician merely removes the stop bar 60 from its stored position (FIG. 1) and mounts it across the car roof 4 between the opposing guide rails 12 as shown in FIG. 8. In this position an electrical contact 66 on each side of the underside of the stop bar 60 contacts an associated electrode 68 extending from the car roof 4 to complete a bridge circuit thereby automatically switching the control circuit of the elevator 1 to inspection mode. As the support struts 62 of this embodiment are shorter than in the previous embodiments, the technician is capable of moving the car 2 up towards the proposed temporary safety space without fouling against the nuts 19 and the bolts 18 securing the guide rails 12 to the hoistway 10. In that position, the technician screws temporary bolts 64 into threaded holes 15 on the opposing guide rails 12 and then continues to move the car 2 upwards until the support struts 62 bear against the temporary bolts 64. The car 2 is prevented from further upward motion and thereby the upper safety space is created.

A further arrangement is also envisaged wherein the support struts are longer than in the embodiment shown in FIG. 4 and instead of engaging with nuts or bolts mounted on or through the opposing guide rails, the struts capable of extending into holes provided at regular distances along the support flanges of the opposing guide rails. Naturally such a stop bar would have to be telescopic since its extended length is inherently greater than the distance between the opposing guide rails.

Since the maintenance technician must generally climb onto the roof 4 of the car 2 to switch (whether manually or through installation of the stop bar 60) the control system of the elevator 1 to inspection mode, the roof 4 is the most logical place to store and install the stop bar 20, 40, 50, or 60. However, it will be appreciated that the stop bar 20, 40, 50 or 60 could alternatively be installed on the bottom of the car or indeed on a counterweight of the elevator 1 having its own guide rails.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. A method for creating a temporary safety space within an elevator hoistway by preventing upward or downward movement of an elevator car along a guide rail, the method comprising the steps of:

providing engagement members on the guide rail; and extending support struts in a same direction from the car to both sides of a guide blade of the guide rail, whereby upward or downward movement of the elevator car along the guide rail is prevented when the extended support struts bear directly against the engagement members, wherein the engagement members are bolts and nuts that permanently secure the guide rail to the hoistway.

2. The method according to claim 1, wherein the support struts define a channel there between, the support struts being engageable with the guide rail so that the channel partially accommodates the guide blade.

3. The method according to claim 1, further comprising the step of securing the support struts to the elevator car.

4. The method according to claim 1, wherein the support struts are arranged symmetrically about the guide blade when extended to bear against the engagement members.

5. A method for creating a temporary safety space within an elevator hoistway by preventing upward or downward movement of an elevator car along a guide rail, the method comprising the steps of:

providing engagement members on the guide rail; and extending support struts in a same direction from the car to both sides of a guide blade of the guide rail, whereby upward or downward movement of the elevator car along the guide rail is prevented when the extended support struts bear directly against the engagement members, wherein the engagement members are bolts and nuts that are temporarily securable to the guide rail for the purpose of engaging with the support struts.

6. The method according to claim 5, wherein the support struts define a channel there between, the support struts being engageable with the guide rail so that the channel partially accommodates the guide blade.

7. The method according to claim 5, further comprising the step of securing the support struts to the elevator car.

8. The method according to claim 5, wherein the support struts are arranged symmetrically about the guide blade when extended to bear against the engagement members.

* * * * *